United States Patent [19]

Mueller

[11] Patent Number: 4,618,748

[45] Date of Patent: Oct. 21, 1986

[54] SWITCHING DEVICE FOR ELECTRICAL SWITCHING APPARATUS

[75] Inventor: Manfred Mueller, Amberg, Fed. Rep. of Germany

[73] Assignee: Siemens Aktiengesellschaft, Munich and Berlin, Fed. Rep. of Germany

[21] Appl. No.: 661,094

[22] Filed: Oct. 15, 1984

[30] Foreign Application Priority Data

Oct. 14, 1983 [DE] Fed. Rep. of Germany ..... 3337515

[51] Int. Cl.[4] ..... H01H 33/20

[52] U.S. Cl. ..... 200/144 R; 200/147 R

[58] Field of Search ..... 200/144 R, 147 R

[56] References Cited

U.S. PATENT DOCUMENTS 2,821,594 1/1958 Latour ..... 200/147 R 3,118,036 1/1964 Gauthier et al. ..... 200/144 R 4,477,704 10/1984 Mori et al. ..... 200/144 R

*Primary Examiner*—Robert S. Macon

*Attorney, Agent, or Firm*—F. W. Powers; J. L. James

[57] ABSTRACT

A switching device is provided for electrical switchgear, particularly contactors. The switching device includes a step-shaped, bowed current lead with a contact portion cooperating with a contact portion of a switch bridge. The switching device also includes a U-shaped arc chute and a fastening bolt. The arc chute surrounds the contact portion with an air gap so that the electrical connection is made solely via the fastening bolt. The edge portions of the arc chute are set back in the area of the contact portion so that the contact portion of the contact bridge cannot come in contact with the arc chute even though the contact bridge may be obliquely positioned.

4 Claims, 1 Drawing Figure

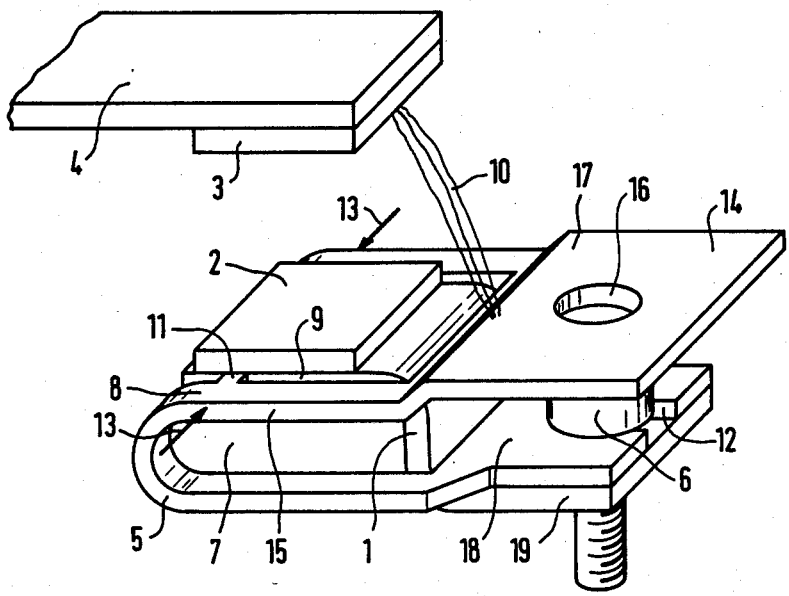
4
3
10
17
16
14
13
2
11
9
8
13
12
6
5
7
15
1
18
19

SWITCHING DEVICE FOR ELECTRICAL SWITCHING APPARATUS

BACKGROUND OF THE INVENTION

The invention involves a switching device for electrical switching apparatus, particularly contactors, with a substantially straight current conductor and an arc chute located at a distance from the contact portion, which, along with the current conductor, forms a U and whose arc-carrying free end extends at approximately the level of the contact portion.

In one switching device of the above-specified type, for instance that disclosed in U.S. Pat. No. 3,211,867, the arc chute is bolted across the frontal side of a relatively massive current lead. A layer of insulating material is installed between the arc chute and the current lead so that the conductor and arc chute operate like a U in creating a motive force on the arc. Since the space between the two legs of the U is relatively slight at this point, the motive effect on the arc is not particularly great. In addition, the contact portion of the device is practically on the same level with the entire arc chute so that a particularly precise alignment for the movable switching device is required in order to be sure that the contact portion of the movable switching device does not make contact with the arc chute.

This situation applies as well to another prior art switching device illustrated in German Patent Publication No. 28 03 249. Here, in addition, the current lead itself is designed in a U shape so that the switching device can only be used for units with lower current-carrying capacities since with high currents the U-shaped power lead causes a lifting of the switch bridge to occur.

It is therefore an object of this invention to provide an improved switching device which is to manufacture and install, and is suitable for use with switching devices which can be manufactured without maintaining tight tolerances for the switching device alignment.

SUMMARY OF THE INVENTION

Briefly stated, in accordance with one aspect of the invention the foregoing object is achieved by providing an arc deflector itself designed in a U-shape, with the U-leg in the area of the contact portion being offset parallel to the contact point, while the other U-leg, penetrated by a fastening bolt, lies on that side of the free end of the step-shaped offset current lead that faces the contact point.

Adjusting the required air gap between the contact portion and current lead and arc chute can be easily achieved if slugs are molded on the arc chute facing the current lead. If an open slot on the fastening leg of the arc chute is designed to be the fastening arch, then the arc chute can easily be slid in once the fastening bolt has passed through the fastening hole of the current lead. By pressing the deflector plate together from the side, the slugs are pressed against the power feed so that the power feed and arc deflector, along with fastening bolt, form an integral unit.

BRIEF DESCRIPTION OF THE DRAWING

While the specification concludes with claims particularly pointing out and distinctly claiming the subject matter which is regarded as the invention, it is believed that the invention will be better understood from the following description of the preferred embodiment taken in conjunction with the accompanying drawing in which FIG. 1 represents a contact arrangement and associated conductors formed in accordance with the invention.

DESCRIPTION OF A PREFERRED EMBODIMENT

The switching device consists of the step-shaped, bowed current lead 1 with a contact portion 2, which cooperates with contact portion 3 of a switch bridge 4, as well as the U-shaped arc deflector 5 and the fastening bolt 6. The arc deflector has a cutout 7, into which part of the current lead 1 penetrates, specificially such that between the current lead 1 and the edge pieces 8 of the arc deflector an air space 9 is provided around the contact portion 2 so that the arc deflector initially is electrically connected with the current lead 1 only by the fastening bolt 6. The step-shaped current lead 1 has the advantage that the current-carrying capacity of the contact arrangement is not negatively affected by a U-shaped current lead. However, once the arc 10 passes onto the arc deflector, the U-shape is available for the arc travel, i.e., there is a switchable current loop for the arc travel. A pair of slugs one of which is visible at 11, slightly bridge the air gap but have no practical effect on this process. They serve, however, to facilitate pre-assembly of the switching device. For that purpose, the fastening bolt 6 is passed into the fastening hole in the current lead 1. The arc deflector is inserted through open slot 12 between the fastening bolt and the current lead. Thereafter, the slugs are pressed against the current lead 1 by compressing the edge pieces 8 in the direction of the arrows 13 to form a pre-assembled unit.

As the drawing shows, the free end 14 of the arc deflector 5 is approximately at the same height as contact portion 2. Section 15 of the leg 17 is offset parallel thereto, specifically tending away from the contact point. This means that the contact arm 4 can also have occasional oblique contact without thereby coming into contact with the edge portions 8 of the arc deflector. The opening in the U is, however, so large that an adequate arc travel is assured without detrimentally affecting the current-carrying capacity of the switching device. The fastening bolt 6 cannot be lost after compression, since the bolt head is larger than opening 16, which is provided to allow access for a screwdriver.

As will be evident from the foregoing description, certain aspects of the invention are not limited to the particular detail of the examples illustrated, and it is therefore contemplated that other modifications or applications will occur to those skilled in the art. It is accordingly intended that the claims shall cover all such modifications and applications as do not depart from the true spirit and scope of the invention.

What is claimed as new and desired to be secured by Letter Patent of the United States is:

1. In a switching means for electrical switchgear having a pair of contacts, particularly a contactor, with a substantially linear current lead and an arc deflector arranged adjacent the contact portion, said arc deflector forming a U the free end of which accepts an arc drawn between said contacts, said U being aligned approximately at the level of one of the contacts, the improvement comprising a step-shaped current lead bearing a contact and an arc deflector having a U-shape, one leg portion of the U lying in the area of the stationary contact being offset parallel to the contact, while the other leg portion of the U is penetrated by a fastening bolt and rests against the contact-bearing side of the free end of the step-shaped offset current lead.

2. A switching device in accordance with claim 1, further including slugs extending from the arc deflector toward the current lead.

3. A switching device in accordance with claim 1, further including an open slot in said other leg portion and registering with said fastening bolt.

4. A switching device in accordance with claim 1, wherein said arc deflector is made of ferromagnetic material.

* * * * *